US005240463A

United States Patent [19]

Weinheimer et al.

[11] Patent Number: 5,240,463

[45] Date of Patent: Aug. 31, 1993

[54] DYEING LEATHER: EXHAUSTION PROCESS USING COMBINATION OF PIGMENT DISPERSION AND AQUEOUS SOLUTION OF WATER-SOLUBLE SULFUR DYE

[75] Inventors: Peter Weinheimer, Bad Vilbel; Norbert Ambrecht, Sulzbach; Lothar Schlösser, Frankfurt am Main, all of Fed. Rep. of Germany

[73] Assignee: Hoechst Aktiengesellschaft, Frankfurt, Fed. Rep. of Germany

[21] Appl. No.: 827,442

[22] Filed: Jan. 29, 1992

[30] Foreign Application Priority Data

Jan. 30, 1991 [DE] Fed. Rep. of Germany ..... 4102670

[51] Int. Cl.[5] ..... C07B 67/46; D06P 1/30; D06P 1/44; D06P 3/32

[52] U.S. Cl. ..... 8/436; 8/437; 8/637.1; 8/642; 8/650; 8/651; 8/652

[58] Field of Search ..... 8/436, 637.1, 651

[56] References Cited

U.S. PATENT DOCUMENTS

| | | | |
|---|---|---|---|
| 4,341,716 | 7/1982 | Diery et al. | 558/165 |
| 4,403,077 | 9/1983 | Uhrig et al. | 525/502 |
| 4,717,390 | 1/1988 | Dien | 8/436 |
| 5,007,941 | 4/1991 | Martinelli et al. | 8/436 |

FOREIGN PATENT DOCUMENTS

| | | |
|---|---|---|
| 1158384 | 12/1983 | Canada . |
| 2061632 | 8/1992 | Canada . |

*Primary Examiner*—A. Lionel Clingman
*Attorney, Agent, or Firm*—Connolly and Hutz

[57] ABSTRACT

The process for dyeing leather by the exhaust method comprises allowing a pigment dispersion and an aqueous solution of sulfur dye to act on the conventionally pretreated leather in one step or in succession. It affords a high depth of shade and a high brilliance which are not achieved by using the pigment or the sulfur dye on its own.

15 Claims, No Drawings

DYEING LEATHER: EXHAUSTION PROCESS USING COMBINATION OF PIGMENT DISPERSION AND AQUEOUS SOLUTION OF WATER-SOLUBLE SULFUR DYE

DESCRIPTION

The invention relates to a process for dyeing leather by the exhaust method.

Leathers are conventionally dyed with water-soluble azo dyes such as those described for example in European patent document A-0 377 409.

By contrast, pigments and sulfur dyes play a subordinate role in leather dyeing by the exhaust method. The pigments used are primarily carbon black pigments and white pigments, although these are not normally used on their own but in combination with water-soluble azo dyes.

It has now been found, surprisingly, that combinations of dispersions containing pigments which do not include dispersed sulfur dyes, with water-soluble sulfur dyes, are outstandingly suitable for dyeing leather by the exhaust method.

The invention thus relates to a process for dyeing leather by the exhaust method, which comprises allowing a pigment dispersion in which the dyes are not dispersed sulfur dyes, and an aqueous solution of water-soluble sulfur dyes, to act on the conventionally pretreated leather. The conventional pretreatment of the leather prior to dyeing includes e.g. tanning and neutralization.

The disadvantage of dyeing leather with water-soluble sulfur dyes without the addition of pigments, according to the invention, is shown in the lack of brilliance of the dyeings. On the other hand, dyeing leather with pigment dispersions alone leads to deficient penetration dyeing in the cross-section. The dyeing normally comes out with a poor brilliance and a poor depth of shade.

The surprising advantage of the combined use of pigment dispersions and water-soluble sulfur dyes is that of a synergistic effect: it permits penetration dyeing in the cross-section coupled with good covering of the surface of the leather and, as a very particular feature, it affords a depth of shade and a brilliance which cannot be achieved under any circumstances by using the individual dyeing components, even in large amounts. The light fastness and perspiration resistance properties achieved are superior to those obtainable by processes conventionally used hitherto.

The aqueous pigment dispersions used in the liquor usually have the following composition:

10–60% by weight, preferably 20–40% by weight of pigment,

2–30% by weight, preferably 4–12% by weight of dispersant,

0–30% by weight, preferably 5–12% by weight of solvent,

0–5% by weight, preferably 0.1–1% by weight of preservative,

30–70% by weight, preferably 35–55% by weight of water.

The pigment is composed of water-insoluble inorganic or organic material and includes e.g. all conventional white, black and colored pigments such as titanium dioxide, zinc oxide, barium sulfate, silicon dioxide, chromium oxide green, cobalt blue, ultramarine blue, iron blue, sienna brown, black iron oxide, carbon black, azo pigments, laked azo pigments, phthalocyanine pigments, dioxazine pigments, perylenetetracarboxylic acid pigments, quinacridone pigments, triphenylmethane pigments, thioindigo pigments and polymethine pigments. The average grain size of the pigment is usually 20 to 1000, especially 100 to 500 nm.

Suitable dispersants are compounds which have a molecular weight of 400 to 10,000 g/mol, preferably 500 to 5000 g/mol, which are also capable of lowering the surface tension of water by virtue of their surface-active properties, and whose molecules contain surface-active structural elements such as, for example, polyether functional groups, carboxyl functional groups, sulfonic acid groups, amino functional groups or quaternary ammonium functional groups.

Suitable dispersants are especially alkylphenol ethoxylates (European patent document A-0 065 751), poly-ether-polyamines (European patent document A-0 025 998) and alkoxylation products, e.g. alkoxylated reaction products of glycidyl ethers with alkylamines (European patent document A0 017 189).

Suitable solvents are polar organic solvents, for example organic compounds carrying OH groups and/or ethers.

Examples of suitable solvents are compounds of the formula $$R^1—O—(X—O)_m—R^2$$

in which:

$R^1$ is hydrogen and/or alkyl having 1 to 35 carbon atoms, for example tallow oil alkyl, palm oil alkyl, coconut oil alkyl, rape oil alkyl or fish oil alkyl, X is $—CH_2—CH_2—$ and/or $—CH_2—CH(CH_3)—$, m is a number from 1 to 50, preferably 1 to 25, and $R^2$ is hydrogen, benzoyl or naphthoyl.

Examples of suitable preservatives are quaternary ammonium salts such, as didecyldimethylammonium chloride, phenols such as 4-chloro-3-methylphenol or orthophenylphenol, and heterocyclic compounds such as octylisothiazolin-3-one, isothiazoline, 1,2-benzisothiazolin-3-one and methyl benzimidazolylcarbamate.

Suitable sulfur dyes are the commercially available water-soluble dyes such as, for example, those described in Melliand Textilberichte 12/1973, pages 1314 to 1327. These dyes include water-soluble pigments and colored salts (thiosulfuric acid derivatives).

The pigment dispersion and sulfur dye are applied either together in a liquor or separately in two successive steps, in which case the order of application is not critical. The sulfur dye can also be composed of a mixture of different sulfur dyes; if appropriate, a dye mixture comprising one or more sulfur dyes and one or more other water-soluble or water-dispersible dyes is used, it being possible for the dye mixture additionally to contain the pigment dispersion. Other water-soluble dyes which can be combined with the water-soluble sulfur dye are acid dyes and direct dyes, e.g. azo dyes containing sulfonic acid groups, metal complex dyes, nitro and nitroso dyes, carbonyl dyes, polymethine dyes, phthalocyanine dyes and reactive dyes. These dyes have an anionic charge character.

The conventionally prepared and pretreated leather is dyed by the exhaust method with the sulfur dye, if appropriate in the presence of the pigment dispersion and/or other water-soluble dyes conventionally used in leather dyeing. The dye liquor is an aqueous solution which contains—based on the shaved weight of the leather—20 to 400, especially 50 to 200% of water, 0.5 to 8, especially 1.5 to 6% of sulfur dye and, if appropriate, 0.1 to 6, especially 0.1 to 3% of pigment dispersion and/or 0.1 to 6, especially 0.1 to 4% of another water-soluble dye. The temperature of this aqueous solution is 20° to 100°, especially 30° to 60° C. The total dyeing time depends on the type of leather to be dyed and is 20 to 300, especially 30 to 120 minutes.

Conventional additives are incorporated into the liquor before, during and/or after dyeing. Said additives are e.g. assistants which promote the penetration of the dyes and pigments, those which lead to a uniform application, which are known as leveling assistants, and those which strengthen the fixing of the dyes and pigments to the leather surface. Other conventional additives are wetting agents, bathochromic agents and stuffing agents.

The entire dyeing process is ended by lowering the pH of the dye liquor, preferably with formic acid. The formic acid is conventionally allowed to act for 10 to 60 minutes. The leather is finished in a manner known per se. One procedure is for the pigmenting of the leather with the pigment dispersion according to the invention to be carried out after the dyeing process, it being possible for this aftertreatment to include simultaneous renewed dyeing with water-soluble sulfur dye. On the other hand, if pigmentation has already been carried out, the retanning and then the so-called top dyeing of the leather and fixing with conventional assistants follow as final steps. The top dyeing can be carried out using the same or different dyes and/or pigments.

The dyeing process according to the invention is suitable for all types of leather, e.g. mineral-tanned or vegetable-tanned shagreen, suede leather, velours leather or nubuk leather from cows, goats, sheep or pigs.

The invention is illustrated in greater detail by the following Examples.

Examples

| Phase | Amount | Product | Temperature | Time |
|---|---|---|---|---|
| 1. Leather for shoe uppers: | | The percentages are by weight, based on the shaved weight. The process is described as from the tanning step. | | |
| Washing | 300.0% | water | 40° C. | 10 min |
| Neutralization | 150.0% | water | 40° C. | |
| | 1.5% | sodium formate | | 30 min |
| | 1.0% | sodium bicarbonate | | 60 min |
| Dyeing and pigmenting | 50.0% | water | 30° C. | |
| | 0.8% | ammonia (25%) | | 10 min |
| | 2.0% | m-benzenedisulfonic acid (disodium salt) | | 15 min |
| | 2.5% | water-soluble sulfur dye; Color Index Solubilized Sulfur black 1 | | |
| | 2.0% | carbon black dispersion (40%); Color Index Pigment black 77266 | | 45 min |
| | 1.0% | melamine/formaldehyde/urea condensation product | | 15 min |
| Retanning | 10.0% | dihydroxydiphenyl sulfone/ naphthalenesulfonic acid/ formaldehyde condensation product | | 60 min |
| | 100.0% | water | 70° C. | |
| | 8.0% | oxysulfited fish oil | | 45 min |
| | 3.0% | formic acid (85%) | | 20 min |
| | | drain off liquor | | |
| Top dyeing and fixing | 150.0% | water | 50° C. | |
| | 1.0% | water-soluble sulfur black; Color Index Solubilized Sulfur black 1 | | |
| | 1.0% | carbon black dispersion (40%); Color Index Pigment black 77266 | | 30 min |
| | 1.0% | formic acid (85%) | | 20 min |
| | 0.5% | dicyandiamide/formaldehyde condensation product | | 20 min |
| 2. Leather for shoe uppers: | | The percentages are by weight, based on the shaved weight. The process is described as from the tanning step. | | |
| Washing | 300.0% | water | 40° C. | 10 min |
| Neutralization | 150.0% | water | 40° C. | |
| | 1.5% | sodium formate | | 30 min |
| | 1.0% | sodium bicarbonate | | 60 min |
| Dyeing and pigmenting | 50.0% | water | 30° C. | |
| | 0.8% | ammonia (25%) | | 10 min |
| | 2.0% | m-benzenedisulfonic acid (disodium salt) | | 15 min |
| | 4.5% | water-soluble sulfur blue dye; Color Index Solubilized Sulfur blue 7 | | |
| | 2.0% | pigment blue dispersion (40%); Color Index Pigment blue 15:3 | | 45 min |
| | 1.0% | melamine/formaldehyde/urea condensation product | | 15 min |
| Retanning | 10.0% | Dihydroxydiphenyl sulfone/ naphthalenesulfonic acid/ | | 60 min |

-continued

| Phase | Amount | Product | Temperature | Time |
|---|---|---|---|---|
| | | Examples | | |
| | | formaldehyde condensation product | | |
| | 100.0% | water | 75° C. | |
| | 8.0% | oxysulfited fish oil | | 45 min |
| | 3.0% | formic acid (85%) | | 20 min |
| | | drain off liquor | | |
| Top dyeing and fixing | 150.0% | water | 50° C. | |
| | 1.0% | water-soluble sulfur blue dye; Color Index Solubilized Sulfur blue 7 | | |
| | 1.0% | pigment blue dispersion (40%); Color Index Pigment blue 15:3 | | 30 min |
| | 1.0% | formic acid (85%) | | 20 min |
| | 0.5% | dicyandiamide/formaldehyde condensation product | | 20 min |
| 3. Upholstery leather: | | The percentages are based on the dry weight. The process is described as from the tanning, stuffing and drying steps. | | |
| Wetting-back | 100.0% | water | 50° C. | |
| | 2.0% | ammonia | | |
| | 2.0% | $C_{12-16}$ oxoalcohol with 8 ethylene oxide units | | 120 min |
| | | new liquor | 50° C. | |
| Dyeing | 400.0% | water | 50° C. | |
| | 2.5% | naphthalenesulfonic acid/ formaldehyde condensation product | | |
| | 2.0% | ammonia (25%) | | |
| | 4.0% | water-soluble sulfur brown dye; Color Index Solubilized Sulfur brown 51 | | 30 min |
| | 2.0% | formic acid | | 30 min |
| | | new liquor | | |
| Pigmenting | 400.0% | water | 30° C. | |
| | 2.0% | polyacrylate dispersion | | 15 min |
| | 2.0% | water-soluble sulfur brown dye; Color Index Solubilized Sulfur brown 51 | | |
| | 2.0% | pigment brown dispersion (22%); Color Index P.O. 36 | | |
| | 1.0% | pigment white dispersion (40%); Color Index Pigment white 77891 | | 90 min |
| | 2.0% | formic acid (85%) | | 20 min |

What is claimed is:

1. A process for dyeing leather by the exhaust method, which comprises allowing a pigment dispersion consisting essentially of a pigment, a dispersant and water and an aqueous solution of sulfur dye to act on the leather in one step or in succession.

2. The process as claimed in claim 1 wherein a pigment dispersion comprising the following composition is allowed to act on the leather: 10 to 60% by weight of pigment, 2 to 30% by weight of dispersant, 0 to 30% by weight of solvent, 0 to 5% by weight of preservative and 30 to 70% of water.

3. The process as claimed in claim 1 wherein an aqueous solution of sulfur dye is allowed to act on the leather, said solution of sulfur dye containing, based on the shaved weight of the leather, 20 to 400% by weight of water, 0.5 to 8% by weight of sulfur dye and, optionally, 0.1 to 6% by weight of pigment dispersion and/or 0.1 to 6% by weight of another water-soluble dye.

4. The process as claimed in claim 1 wherein the dyeing time is 20 to 300 minutes.

5. The process as claimed in claim 2 wherein said composition comprises:

20 to 40% by weight of pigment, 4 to 12% by weight of dispersant, 5 to 12% by weight of solvent, 0.1 to 1% by weight of preservative, and 35 to 55% by weight of water.

6. The process as claimed in claim 1 wherein an aqueous solution of sulfur dye is allowed to act on the leather, said solution of sulfur dye containing, based on the shaved weight of the leather, 20 to 400% by weight of water, 0.5 to 8% by weight of sulfur dye and, optionally, 0.1 to 6% by weight of pigment dispersion and/or 0.1 to 6% by weight of another water-soluble dye.

7. The process as claimed in claim 3 wherein said aqueous solution of sulfur dye contains, based on the shaved weight of the leather, 50 to 200% by weight of water, 1.5 to 6% by weight of sulfur dye, and, optionally, 0.1 to 3% by weight of pigment dispersion and/or 0.1 to 4% by weight of another water-soluble dye.

8. The process as claimed in claim 1 wherein the dyeing time is 30 to 120 minutes.

9. The process as claimed in claim 6 wherein said aqueous solution of sulfur dye contains, based on the shaved weight of the leather, 50 to 200% by weight of water, 1.5 to 6% by weight of sulfur dye, and, optionally, 0.1 to 3% by weight of pigment dispersion and/or 0.1 to 4% by weight of another water-soluble dye.

10. The process as claimed in claim 2, wherein the dyeing time is 30 to 120 minutes.

11. The process as claimed in claim 3, wherein the dyeing time is 30 to 120 minutes.

12. The process as claimed in claim 6, wherein the dyeing time is 30 to 120 minutes.

13. A process for dyeing leather by the exhaust method, which comprises allowing a pigment dispersion comprising 10 to 60% by weight of pigment, 2 to 30% by weight of dispersant, 0 to 30% by weight of solvent, 0 to 5% by weight of preservative, and 30 to 70% by weight of water, and an aqueous solution of sulfur dye containing, based on the shaved weight of the leather, 20 to 400% by weight of water and 0.5 to 8% by weight of sulfur dye, to act on the leather in one step or in succession.

14. A process according to claim 13, wherein said aqueous solution further comprises 0.1 to 6% by weight of pigment dispersion and/or 0.1 to 6% by weight of another water-soluble dye.

15. A process for dyeing leather by the exhaust method, which comprises allowing a pigment dispersion consisting essentially of a pigment, a dispersant and water and an aqueous solution of sulfur dye to act on the leather in succession.

* * * * *